US005181640A

United States Patent [19]

Vossen et al.

[11] Patent Number: 5,181,640

[45] Date of Patent: Jan. 26, 1993

[54] APPARATUS FOR REMOVING BREAK-OUT PORTIONS FROM A SHEET OF MATERIAL OR THE LIKE

[75] Inventors: Franz Vossen; Karl-Anton Stoppel, both of Stockach-Wahlwies, Fed. Rep. of Germany

[73] Assignee: Meurer Nonfood Product GmbH, Radolfzell, Fed. Rep. of Germany

[21] Appl. No.: 667,448

[22] Filed: Mar. 11, 1991

[30] Foreign Application Priority Data

Mar. 12, 1990 [DE] Fed. Rep. of Germany ... 9003017[U]

[51] Int. Cl.[5] ..... B26D 7/18; B26F 1/40

[52] U.S. Cl. ..... 225/93; 227/97; 83/109

[58] Field of Search ..... 83/109, 162, 165; 225/104, 103, 97, 93

[56] References Cited

U.S. PATENT DOCUMENTS

| | | | |
|---|---|---|---|
| 3,054,544 | 9/1962 | Partington | 225/93 |
| 3,552,615 | 1/1971 | Murray | 225/97 |
| 3,756,107 | 9/1973 | Pax et al. | 83/165 |
| 3,784,070 | 1/1974 | Vossen | 225/97 X |
| 3,889,563 | 6/1975 | Westermann | 83/165 X |
| 3,949,653 | 4/1976 | Schröter | 225/103 X |
| 4,367,069 | 1/1983 | Bishop | 225/97 X |

*Primary Examiner*—Douglas D. Watts
*Assistant Examiner*—Reinaldi Rada
*Attorney, Agent, or Firm*—Bachman & LePointe

[57] ABSTRACT

Apparatus for removing break-out portions and in particular waste pieces from a sheet of material which contains blanks or the like and which rests on a break-out surface in such a way that the break-out portion extends over an aperture in the break-out surface and is pressed downwardly through the aperture under the pressure of at least one break-out member, in particular a break-out pin. Associated with the break-out member beneath the break-out portion is a support which is guided in the direction of movement of the break-out member. The support is a surface which is springy and/or movable within the aperture at least partially into a position at a spacing relative to the break-out surface and which in its rest position engages beneath the waste piece in the sheet of material and which is adapted to be transferred into an inclined position relative to the sheet of material upon movement of the waste piece by the break-out member, in particular upon downward movement of the waste piece.

18 Claims, 5 Drawing Sheets

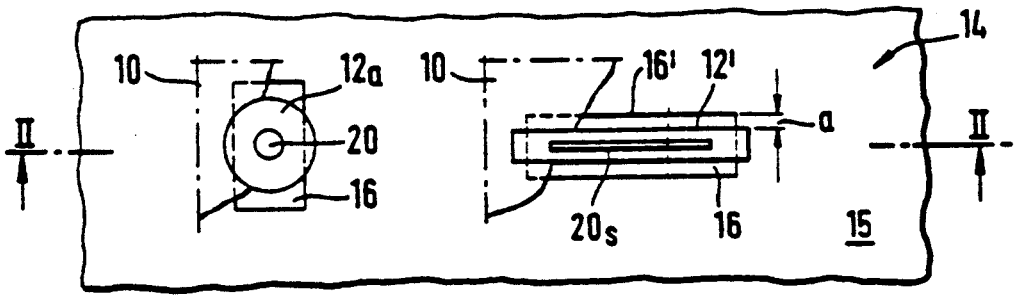
(PRIOR ART) FIG. 1
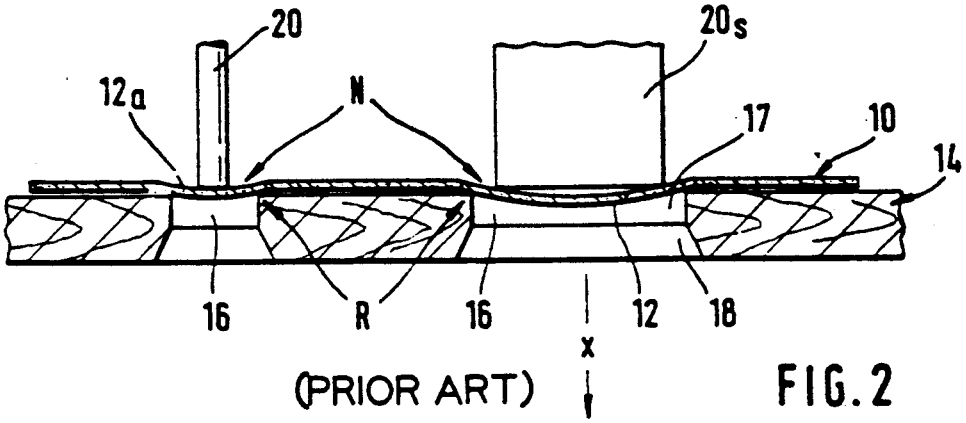
(PRIOR ART) FIG. 2
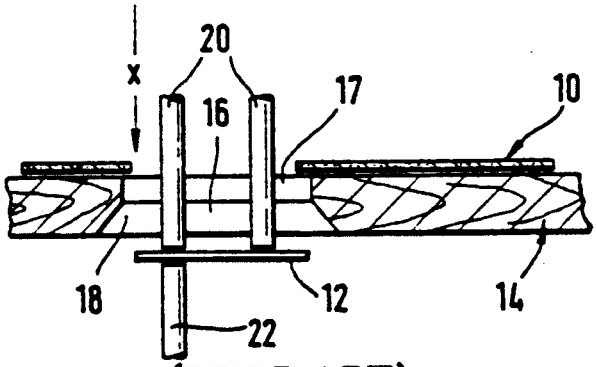
(PRIOR ART) FIG. 3
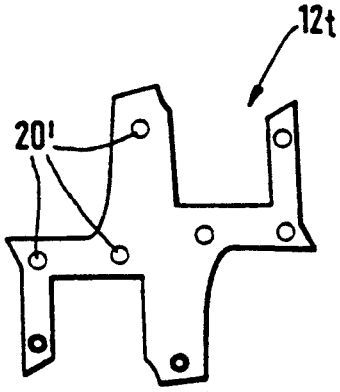
FIG. 4

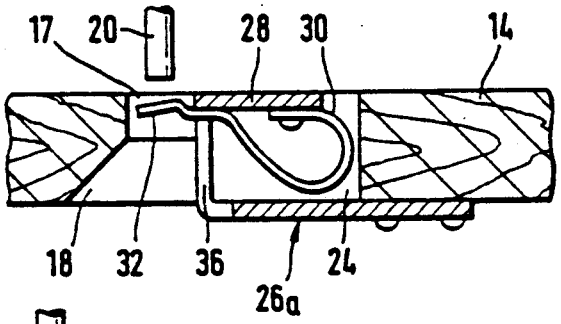
FIG.10
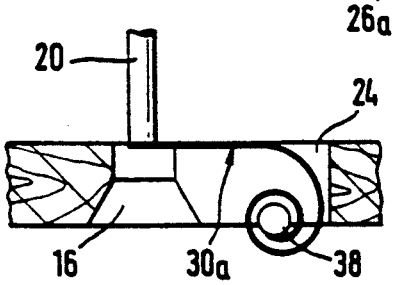
FIG.11
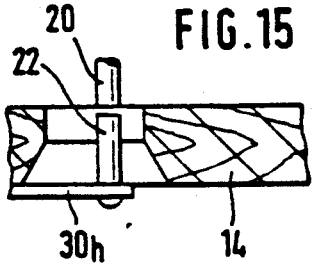
FIG.15
FIG.12
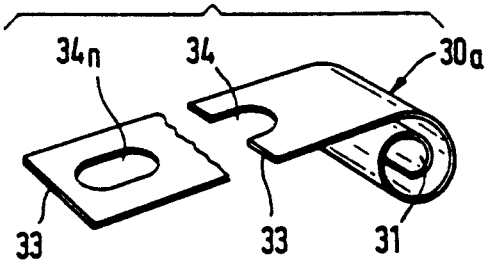
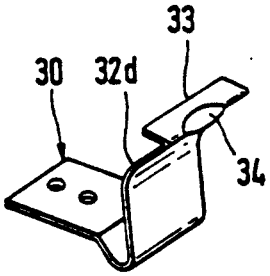
FIG.13
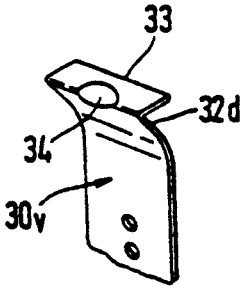
FIG.14
FIG.16
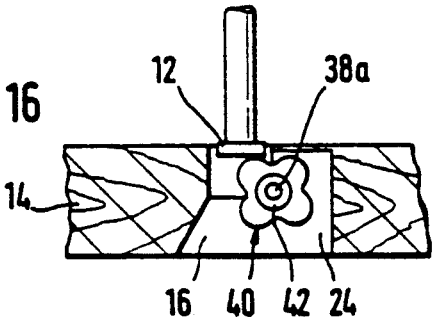
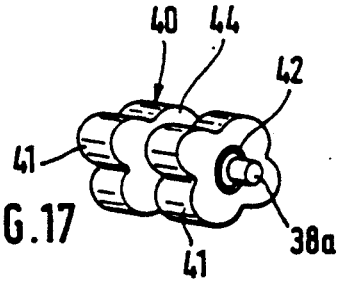
FIG.17
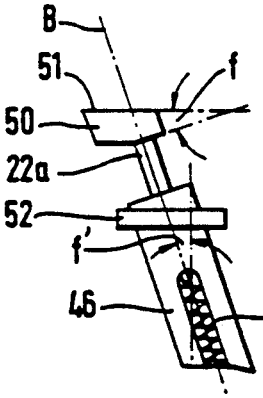
FIG.19
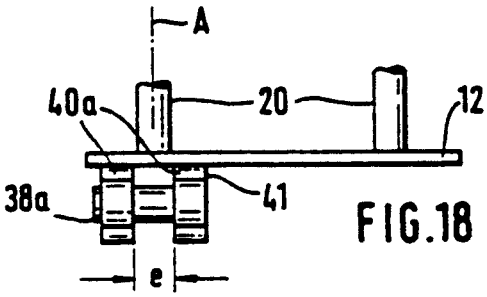
FIG.18

APPARATUS FOR REMOVING BREAK-OUT PORTIONS FROM A SHEET OF MATERIAL OR THE LIKE

BACKGROUND OF THE INVENTION

The invention relates to an apparatus for removing break-out portions and in particular waste pieces from a sheet of material which contains blanks or the like and which rests on a break-out surface in such a way that the break-out portion extends over an aperture in the break-out surface and is pressed downwardly through the aperture under the pressure of at least one break-out member, in particular a break-out pin, wherein associated with the break-out member beneath the break-out portion is a support which is guided in the direction of movement of the break-out member.

For more than thirty years automatic stamping machines for producing blanks from sheets of cardboard in the folding box industry have been provided with break-out devices which are preferably disposed in a setting-up table outside the stamping machine. Such a break-out station is of particular significance from the point of view of the production operation as, if it is used incorrectly, it takes the greatest proportion of the total setting-up time and a poorly adjusted break-out station results in continuous disturbances in the production procedure.

In the break-out station, after the stamped sheet of cardboard reaches a predetermined retaining position on the break-out surface which is usually provided by a break-out board or die, the waste piece or pieces is removed from the stamped sheet of cardboard by means of break-out pins or cutting edges which press against the cardboard from above.

In the development of the break-out technology, there was first the upper tool pin which presses downwardly and which passes the waste piece through the aperture in the break-out board. The next stage in development added an additional lower tool with lower pins which align with the upper tool pins and which hold the waste piece in position with a clamping effect. As a break-out tool can reliably break out a waste piece only when there is a certain degree of engagement between the tool and the waste piece, the above-indicated lower pins have proven to provide an advantageous resistance at the moment at which the break-out tool or member encounters the waste piece to be broken out.

If the use of a clamping tool is to be avoided, the break-out aperture in the break-out surface at various locations thereon must be kept smaller than the waste piece associated with the respective aperture so that the waste piece lies with a high level of friction on the break-out surface or die, in contact therewith over small surface portions. The resistance now occurs when the break-out pin encounters the waste piece, by virtue of the friction produced. When the break-out pin and the waste portion pass through the aperture, a friction effect occurs at the narrower walls of the hole or aperture, thus producing a certain level of frictional engagement.

Also known is the so-called DYN-pin, being a break-out pin with a tip having substantially conical side walls which have concave contours in cross-section. In the break-out process, the tip of the pin encounters the waste piece which, by virtue of the waste piece being supported against the edges of the aperture, opposes so much resistance to the tip of the break-out pin that the tip can penetrate slightly into the material of the waste piece. That prevents undesired lateral deviation of the waste piece.

When it passes through the aperture, the waste piece bends; the stress between the waste piece and the wall of the aperture presents the DYN-pin with sufficient friction to provide the desired frictional engagement with the waste piece; that possibly makes it unnecessary to provide a bottom tool, per se, when using the DYN-pin.

SUMMARY OF THE INVENTION

Having regard to that state of the art and the break-out process with or without a bottom tool, the inventor set himself the aim of further improving the operation of breaking waste pieces out of sheets of material and in particular simplifying the tool arrangement required for that purpose, not least also in order to reduce the expenditure involved in stockkeeping for the tools; as a special tool is required for almost each sheet configuration, the stockkeeping costs when using the previous tools are disproportionately high.

In the apparatus of the present invention, that object is attained in that the support is a surface which is springy and/or movable within the aperture into a position at a spacing relative to the break-out surface-at least partially, when in an inclined position-and which in its rest position engages substantially parallel beneath the waste piece in the sheet of material and which is adapted to be transferred into an inclined position relative to the sheet of material upon movement and predominantly therefore downward movement of the waste piece by the break-out member.

It has been found particularly advantageous for the support to be in the form of a resilient surface of a tongue-like spring which is fixed at one end to the break-out surface or the so-called break-out board, while the free end thereof is disposed in the aperture and is substantially aligned with the break-out surface in the above-mentioned rest position.

By virtue of that arrangement, provided within the aperture is a resilient support which initially bears from below against the waste piece to be broken out and which is then moved downwardly with same by the break-out pin or the like until its angle of inclination is sufficient for the waste piece which has now been broken out of the sheet of material to be pushed away laterally due to the inclined positioning during the downward stroke movement, relative to the free edge. Tests have shown that the waste piece is pushed away in that fashion by the waste piece being shot or flicked away at astonishing speed.

By virtue of the spring force, that waste piece discharge operation takes place in the same fashion when dealing with all kinds of break-out members but it occurs in the best fashion when using the per se known DYN-pin with substantially tapering tip.

After the waste piece has been flicked away, the spring swings back into its rest position in order to be available for a new breakout operation.

It has been found advantageous for the free end of the tonguelike spring to be bent to provide a step or for the free end of the spring to be bent around at least two bend lines; that configuration provides a spring force which is additional to the spring constant of the material of the spring.

The aperture in the break-out board is usually shaped to correspond to the waste piece to be removed therein, while in accordance with the invention adjoining the aperture in the break-out board is the aperture arm which is preferably directed transversely with respect to the longitudinal axis of the aperture, for receiving the spring which is fixed therein at one end for example on a support profile which extends in the aperture arm, defining therewith the above-mentioned angle of inclination. The support profile or its support portion may in turn either be aligned with the surface of the break-out board or it may extend at a spacing relative thereto, which involves a correspondingly different configuration for the spring tongue which can then also possibly carry a pin which pivots therewith and which in the rest position is coaxial with the break-out pin which comes downwardly from above.

There are a plurality of different configurations in respect of the spring tongue member and the fixing thereof, within the scope of the invention as will be discussed hereinbelow.

The principle according to the invention is also embodied by a bearing surface which is rigid in itself and which can be moved downwardly at a spacing relative to the break-out surface and which can also be set into the described inclined position relative thereto.

A construction which has been found to be particularly suitable for that purpose is an angle member which is limitedly rotatable about an axis and which is subjected to the effect of the return force of a force storage means and which is preferably mounted in a mounting support of the break-out board and which provides a leg as a support.

In accordance with the invention however it is also possible to provide a roller-like body which is rotatable about an axis disposed beside the path of movement of the break-out pin or pins or the like; the periphery of the roller-like body has a plurality of surfaces which are inclined with respect to radii from the axis. A structure which is particularly suitable for that purpose is a roller whose cross-section structurally comprises for example a plurality of circles which engage one into the other, and which provides a peripheral groove through which the path of movement of the break-out pin tangentially passes. It is also possible, instead of the one roller with a peripheral groove, to dispose two disc-like rollers on the axis, the two rollers having peripheral contours which are aligned with each other and the path of movement of the break-out pin lying between the two rollers.

In accordance with a further feature of the invention, extending from the free edge of the support and in particular the spring is at least one edge opening as a means for laterally delimiting the path of movement of the break-out member or pin. Instead of that edge opening which is generally of a part-circular configuration or, when the arrangement has a plurality of break-out members, in addition to that edge opening, it is possible to provide within the support surface a hole whose width is greater than the cross-section of the break-out pin or the like so that, as in the case of the above-described edge opening, the pin cannot come directly into contact with the surface of the spring, as it moves downwardly. That arrangement also considerably improves the waste removal effect.

Further features are set forth hereinbelow.

BRIEF DESCRIPTION OF THE DRAWINGS

Further advantages, features and details of the invention will be apparent from the following description of preferred embodiments and with reference to the drawings in which:

FIG. 1 is a plan view of a part of a break-out board for the removal of waste pieces from sheets of cardboard in the folding box industry, FIG. 2 is a view in section through FIG. 1 taken along line II—II therein, FIG. 3 is a part of the FIG. 2 view, in relation to a further embodiment, FIG. 4 is a plan view of a broken-out waste piece, FIGS. 10 and 11 are views in section through parts of other embodiments of the apparatus, FIGS. 12 to 15 are perspective views showing different spring tongues, FIG. 16 is a view in cross-section through part of a break-out board with a rotatable support for waste pieces, FIG. 17 is a perspective view of the support shown in FIG. 16, FIG. 18 is a front view of another embodiment of the support, FIG. 19 is a side view of a part of another apparatus.

DETAILED DESCRIPTION

Figure 5:
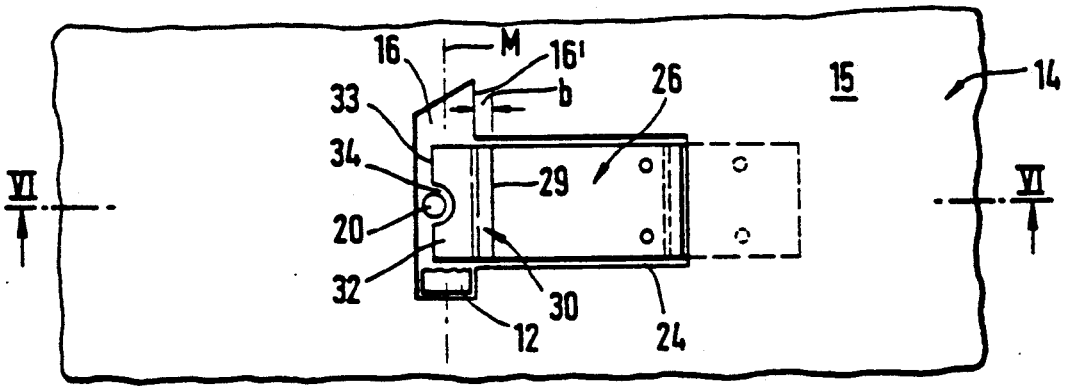
FIG. 5 is a plan view of a part of another break-out board with a spring tongue disposed in an aperture therein.
Figure 6:
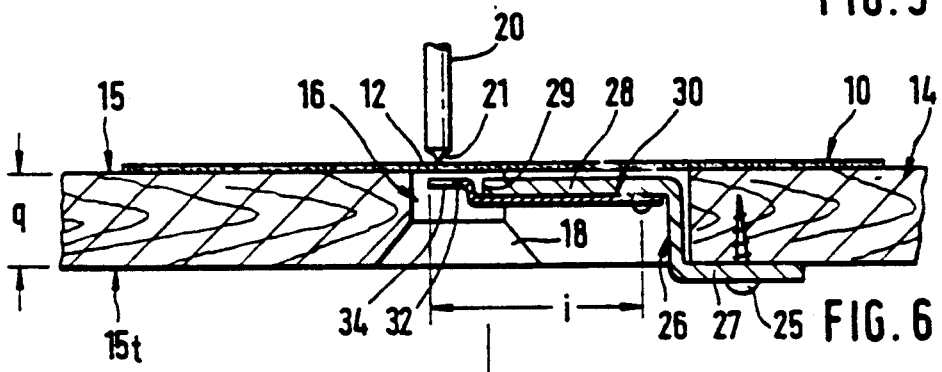
FIG. 6 is a view in section through FIG. 5 in the rest position of the spring tongue.
Figure 7:
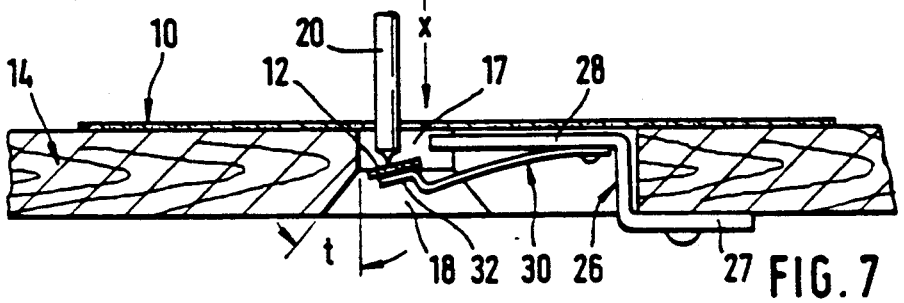
FIGS. 7 and 8 are views corresponding to that shown in FIG. 6, illustrating different operating positions of the spring tongue.
Figure 8:
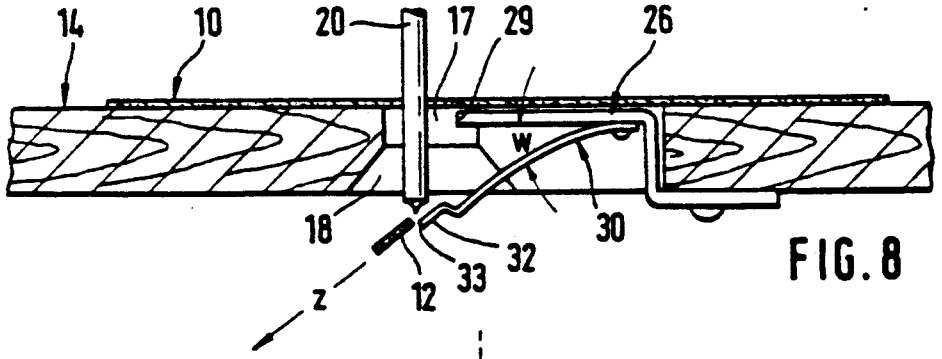

Cardboard sheets 10 which are used in the folding box industry have stamped or punched blanks for folding boxes or the like, wherein waste pieces 12 and $\mathbf{12}_a$ are produced in the blanks or on the blanks.

Downstream of a stamping station which is not shown in the drawing for the sake of clarity thereof, the stamped cardboard sheet 10 passes on to a break-out board or die 14 on which its waste pieces 12 and $\mathbf{12}_a$ are removed therefrom; the waste pieces 12 and $\mathbf{12}_a$ are disposed above apertures 16 which are of a configuration depending on the contours of the waste pieces. As can be seen from the cross-sectional view in FIG. 2, the aperture 16 has an upper frame-like portion 17 with a vertical wall, followed by a downward opening cone portion.

Small edge zones of the waste pieces 12, $\mathbf{12}_a$ lie on the break-out board 14 while other regions of edges 12' of the waste piece 12, $12_a$ extend at a spacing a within the contour of the aperture 16 at the surface 15 of the break-out board 14. That relationship results in support zones as indicated at R in FIG. 2, with a comparatively high level of frictional resistance, and regions indicated at N, with a lower level of friction.

Break-out members 20 press downwardly on to the waste pieces 12, $12_a$, the break-out members 20 pressing against the waste pieces in a punctiform manner when being in the form of pins or with linear contact when being for example in the form of pressing edges $20_s$, as shown at the right in FIGS. 1 and 2. It is also possible to use break-out members of different configurations, although they are not shown.

The waste pieces 12, $12_a$ are separated from the cardboard sheet 10 and carried away downwardly in the break-out direction indicated by x.

FIG. 3 shows a break-out tool with a clamping or bottom pin 22, the surface of which bears against the underneath surface of the waste piece 12 coaxially with respect to the upper break-out pin 20, co-operating with the latter in order clampingly to hold the waste piece 12 in position and thus also to carry it out of the aperture 16.

FIG. 4 shows a typical waste piece $12_t$ which has a plurality of arms and which is subjected to the action of eight break-out pins 20, corresponding to the marked pressure points 20'. Of the eight break-out pins 20, only two (indicated by the black spots in FIG. 4) are supported against respective coaxially disposed bottom pins 22.

The portion shown by way of example from a break-out board 14 according to the invention, as illustrated in FIGS. 5 to 8, illustrates a substantially rectangular aperture 16 for a waste strip piece 12 which is to be broken out. Adjoining the aperture 16 and disposed transversely with respect to its longitudinal axis M is an aperture arm 24 for receiving a support profile member 26 of a stepped configuration; the support profile member 26 is secured by a short mounting portion 27 to the underside $15_t$ of the break-out board 14 at one end by means of screws 25 or the like in such a way that a support portion 28 which is longer than the mounting portion 27 extends adjacent to the surface 15 of the break-out board 14, while the end edge 29 thereof extends at a small spacing b from the parallel edge 16' of the aperture.

Disposed closely against the underneath surface of the support portion 28 is a spring tongue 30 which is secured to the support portion 28 by means of its rearward end region, by riveting or the like, and is otherwise adapted to pivot resiliently downwardly away therefrom. Formed in the spring tongue 30 at its free end is mounting step 32 which is arranged in front of the end edge 29 of the support portion 28 and which is directed in a cranked configuration upwardly. In the rest position shown in FIG. 6, the mounting step 32 is disposed in the aperture 16, with the top side thereof being substantially aligned with the surface 15 of the break-out board 14. The free length i of the spring tongue 30 of approximately 35 millimeters almost corresponds in the selected embodiment to three times the thickness q of the break-out board 14 or the height of the aperture 16 therein. The cone angle t of the cone portion 18 of the aperture 16 is more than 50°.

Figure 9:
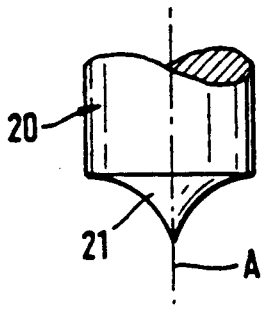
FIG. 9 is a view of a detail from FIGS. 6 to 8 on an enlarged scale.

When the break-out pin 20 which is provided with a pressure tip 21 which has a periphery of a concave configuration as shown in FIG. 9 presses against the waste strip portion 12 which extends over the mounting step 32 of the spring tongue 30, the waste strip piece 12 is pushed downwardly and held clampingly between the step 32 and the break-out pin 20 until the step 32 forms a deflection angle w of about 45° with respect to the horizontal support portion 28 and the broken-out waste strip portion 12 can rapidly move away laterally (as indicated by the arrow z). That release operation is promoted by virtue of the shape of the pressure tip 21 of the break-out pin 20, but it can also be performed when using break-out pins 20 with a flat end (see FIGS. 10 and 11).

As FIG. 5 shows, the step 32 of the spring tongue 30, in the region of its free end 33, has a part-circular opening 34; the path of movement of the break-out pin 20, which is defined by the axis A of the pin, extends within the part-circular opening 34.

The spring tongue 30 in the embodiment shown in FIG. 10 is curved in a loop-like configuration in cross-section between the mounting step 32 and the fixing end thereof, and is fixed under the support portion 28 of a U-shaped support profile member $26_a$, the transverse wall of which has a cut-out portion 36 through which the spring tongue 30 passes; the edges of the cut-out portion 36 delimit deflection of the spring.

As shown in FIGS. 11 and 12, instead of the above-mentioned support profile member 26, a pin or bolt 38 can be secured in the aperture arm 24, the pin or bolt 38 holding and passing through the spring tongue $30_a$ which is rolled in a spiral configuration at its mounting end 31. In this case, instead of the above-described edge opening 34, it is possible, as also in other embodiments, to provide a slot $34_n$ at a spacing relative to the free edge 33, wherein the path of movement of the pin 20 passes through the slot $34_n$.

As shown in FIG. 13, a spring tongue 30 which is fixed at one end at a spacing relative to the surface 15 of the break-out board 14 is bent upwardly with its free end and folded to form a double-layer mounting step $32_d$; that configuration considerably increases the elasticity of the device. Correspondingly folded free ends are also possible in relation to spring tongues $30_v$ as shown in FIG. 14, which project along substantially vertical lines into the aperture 16.

The construction shown in FIG. 15 comprises a spring tongue $30_h$ which is disposed at a spacing relative to the surface 15 of the break-out board 14, and a clamping pin 22 which is thus mounted resiliently and which projects upwardly from the spring tongue $30_h$ and which terminates slightly below the surface 15.

Instead of a spring tongue 30 which bends, it is possible for a roller 40 to be mounted in the aperture arm 24 on a horizontal spindle or shaft 38a in such a way as to be rotatable in a stepwise manner; the roller 40 has a cross-sectional contour which is of a cross-like configuration or which is in the form of a clover leaf configuration, consisting in this case of four part-circles; the elongate bulge configurations which are formed in that way at the outside surface of the roller 40, as indicated at 41, form supports which are movable downwardly, for the break-out pin 20 or the waste piece 12 which is disposed therebetween. The roller 40 is also provided with a central peripheral groove 44 for the axis A of the pin to pass therethrough. Instead of the roller 40 with its peripheral groove 44, it is also possible for two roller discs $40_a$ to be fixed at a spacing e from each other on the shaft $38_a$ (see FIG. 18).

As shown in FIG. 19, the axis B of a bottom clamping pin $22_a$ is arranged in a bush or sleeve 46 inclined at an angle f' of about 20° and the clamping pin $22_a$ is held in the gripping position shown by the force of a spring 48. The clamping pin $22_a$ is provided with an abutment head 50 whose surface 51 includes an angle f in relation to a line which is radial with respect to the axis B, while the surface 51 extends substantially parallel to a fixing collar 52 of the bush or sleeve 46.

Figure 20:
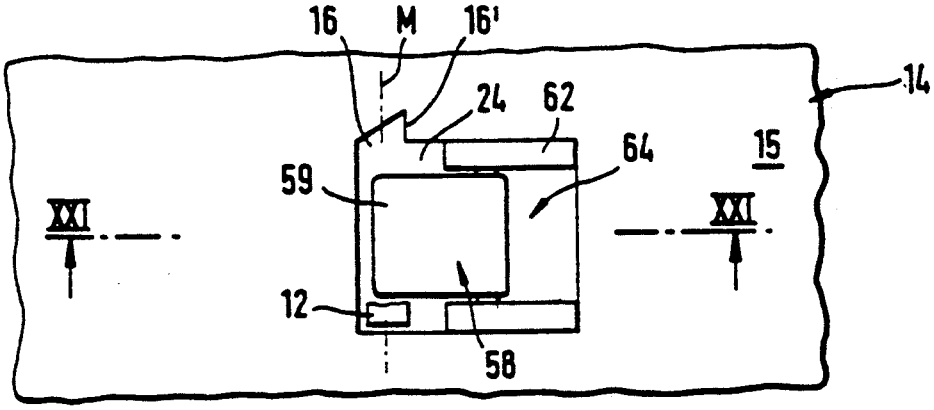
FIG. 20 is a view corresponding to that shown in FIG. 5 of a further construction.
Figure 21:
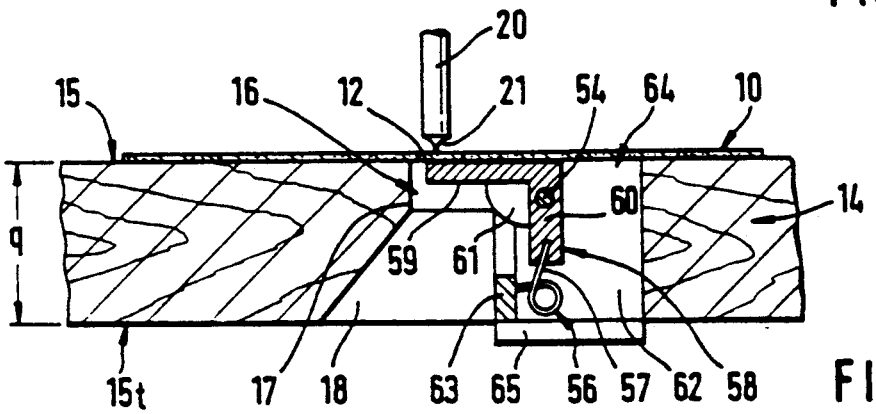
FIG. 21 is a view in section through FIG. 20 taken along line XXI—XXI thereof.
Figure 22:
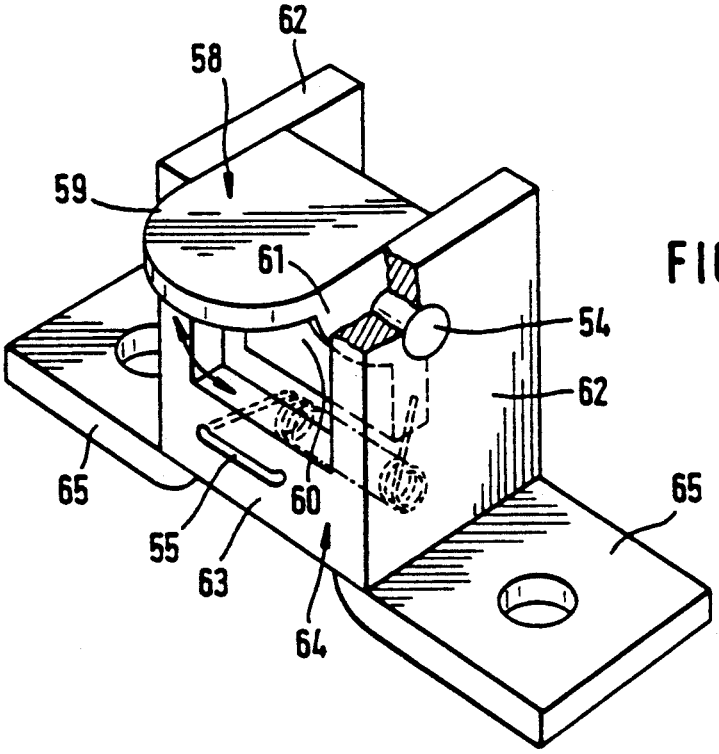
FIG. 22 is a perspective view of a detail from FIGS. 20 and 21.

The construction shown in FIGS. 20 to 22 has, in the aperture 16, an angle member 58 which is capable of limited tilting movement against the force of a spreading spring 56 about a pin or bolt 54 which extends parallel to the break-out board 14. One leg 59 of the angle member 58 extends at the surface 15 of the break-out board 14 while the pin or bolt 54 passes through the other mounting leg 60 of the angle member 58 and possibly also a vane portion 61 formed thereon. The pin or bolt 54 is mounted in side walls 62 of a mounting member 64 which in turn is fixed in position by means of wing-like flanges 65 which engage under the break-out board 14. The side walls 62 are connected by a front transverse web portion 63 of the mounting member 64, in which a free end 55 of the spring 56 is fixed; the other radial end 57 is disposed under the pin or bolt 54 in the mounting leg 60.

Figure 23:
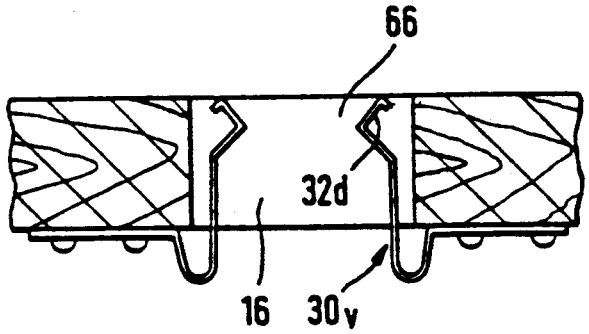
FIG. 23 is a view in cross-section through a break-out board with a pair of spring tongues which are associated with each other.
Figure 24:
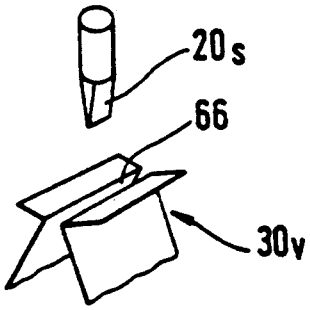
FIG. 24 is a perspective view of a part of FIG. 23, and FIGS. 25 and 26 are views in section of parts of other embodiments of the break-out board.
Figure 25:
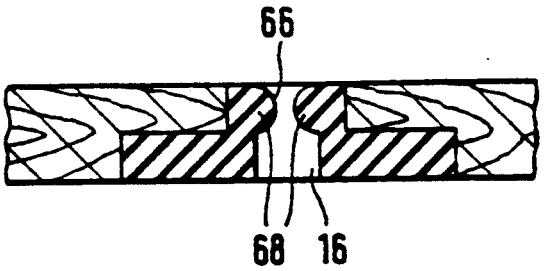
Figure 26:
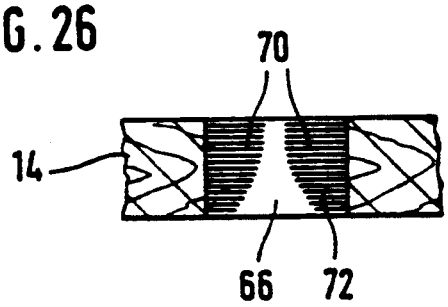

FIG. 23 shows two substantially vertical leaf springs $30_v$ on both sides of the aperture 16. The leaf springs $30_v$ flank a passage gap 66 (see FIG. 24) which defines the path of movement of a break-out pin $20_s$ with a flat end edge or a knife or cutting edge. Such a gap 66, as shown in FIG. 25, is delimited by resilient rubber projections 68 or brush-like inserts 70 (see FIG. 26). Bristles 72 of the brushes 70 extend transversely with respect to the axis A of the pin and are of a length which decreases in the pressing direction so that on the one hand they are capable of serving as a support while on the other hand they permit the waste piece 12 to be carried away downwardly.

We claim:

1. Apparatus for removing break-out portions from a sheet of material, which comprises: a break-out surface having an aperture therein; a sheet of material containing a break-out portion, said sheet resting on the break-out surface so that the break-out portion extends over said aperture; a break-out member operative to press downwardly through said aperture and press said break-out portion downwardly through said aperture; a support surface associated with said break-out member to support said break-out portion, said support surface being guided in the direction of movement of the break-out member, wherein said support surface is movable within the aperture at least partially into a position at a spacing relative to the break-out surface and which in its rest position is located substantially parallel to and beneath the break-out portion in the sheet of material and which is adapted to be transferred into an inclined position relative to the sheet of material upon movement of the break-out portion by said break-out member upon downward movement of the break-out portion, and wherein said support surface is part of an element which is rotatable about an axis against a force storage means into said inclined position, wherein the force storage means produces a return force against said element.

2. Apparatus according to claim 1 wherein said break-out member is a break-out pin.

3. Apparatus according to claim 1 wherein said element comprises an angle member, one leg thereof forming said support surface and the other leg thereof being mounted on a spindle.

4. Apparatus according to claim 3 wherein the break-out surface is contained in a break-out board and wherein the angle member is mounted in a mounting member secured to the break-out board within the aperture.

5. Apparatus according to claim 4 wherein a spindle is supported at both ends thereof in side walls of said mounting member and wherein said side walls extend in the aperture.

6. Apparatus according to claim 5 wherein the force storage means is a spreading spring which is fixed to the angle member and to the mounting member.

7. Apparatus for removing break-out portions from a sheet of material, which comprises: a break-out board having a break-out surface with an aperture therein; a sheet of material containing a break-out portion, said sheet resting on the break-out surface so that the break-out portion extends over said aperture; a break-out member operative to press downwardly through said aperture and press said break-out portion downwardly through said aperture; a support surface associated with said break-out member to support said break-out portion, said support surface being guided in the direction of movement of the break-out member, wherein said support surface is movable within the aperture at least partially into a position at a spacing relative to the break-out surface and which in its rest position is located substantially parallel to and beneath the break-out portion in the sheet of material and which is adapted to be transferred into an inclined position relative to the sheet of material upon movement of the break-out portion by said break-out member upon downward movement of the break-out portion, and wherein said support surface comprises a leaf spring having a free end wherein said spring is fixed at one end thereof to said break-out board, while the free end of the spring is disposed in the aperture, and in said rest position said free end is substantially aligned with the break-out surface.

8. Apparatus according to claim 7 wherein said leaf spring is fixed at a mounting end thereof in a portion of the aperture and extends transversely with respect to a longitudinal axis of the aperture.

9. Apparatus according to claim 7 wherein the free end of the leaf spring is bent to provide a step.

10. Apparatus according to claim 7 wherein said leaf spring is folded at its free end at least about two bend lines.

11. Apparatus according to claim 7 wherein said leaf spring is fixed at one end to a member which is provided in the aperture and which extends adjacent the break-out surface.

12. Apparatus according to claim 7 wherein said leaf spring is fixed at one end at a spacing from the break-out surface and the free end of the spring is bent up relative to said break-out surface.

13. Apparatus for removing break-out portions from a sheet of material, which comprises: a break-out surface having an aperture therein; a sheet of material containing a break-out portion, said sheet resting on the break-out surface so that the break-out portion extends over said aperture; a break-out member operative to press downwardly through said aperture and press said break-out portion downwardly through said aperture; a support surface associated with said break-out member to support said break-out portion, said support surface being guided in the direction of movement of the break-out member, wherein said support surface is movable within the aperture at least partially into a position at a spacing relative to the break-out surface and which in its rest position is located substantially parallel to and beneath the break-out portion in the sheet of material and which is adapted to be transferred into an inclined position relative to the sheet of material upon movement of the break-out portion by said break-out member upon downward movement of the break-out portion, and wherein the support surface is formed by portions of at least one roller body which is rotatable about an axis provided beside the path of movement of the break-out member, and wherein said roller body comprises a plurality of part circles that are spaced apart from each other in a direction parallel to the axis of the break-out member.

14. Apparatus according to claim 13 wherein the roller body has a peripheral groove through which the path of movement of the break-out member extends in substantially tangential relationship.

15. Apparatus for removing break-out portions from a sheet of material, which comprises: a break-out surface having an aperture therein; a sheet of material containing a break-out portion, said sheet resting on the break-out surface so that the break-out portion extends over said aperture; a break-out member operative to press downwardly through said aperture and press said break-out portion downwardly through said aperture; a support surface associated with said break-out member to support said break-out portion, said support surface having a free edge and being guided in the direction of movement of the break-out member, wherein said support surface is movable within the aperture at least partially into a position at a spacing relative to the break-out surface and which in its rest position is located substantially parallel to and beneath the break-out portion in the sheet of material and which is adapted to be transferred into an inclined position relative to the sheet of material upon movement of the break-out portion by said break-out member upon downward movement of the break-out portion, wherein extending from the free edge of said support is at least one edge opening as a means for laterally delimiting the path of movement of the break-out member.

16. Apparatus according to claim 15 wherein the edge opening has a semi-circular configuration.

17. Apparatus for removing break-out portions from a sheet of material, which comprises: a break-out surface having an aperture therein; a sheet of material containing a break-out portion, said sheet resting on the break-out surface so that the break-out portion extends over said aperture; a break-out member operative to press downwardly through said aperture and press said break-out portion downwardly through said aperture; a support surface associated with said break-out member to support said break-out portion, said support surface having a free edge and being guided in the direction of movement of the break-out member, wherein said support surface is movable within the aperture at least partially into a position at a spacing relative to the break-out surface and which in its rest position is located substantially parallel to and beneath the break-out portion in the sheet of material and which is adapted to be transferred into an inclined position relative to the sheet of material upon movement of the break-out portion by said break-out member upon downward movement of the break-out portion, wherein at least one hole having a width is provided in the support adjacent the free edge thereof, the width of said at least one hole being greater than a cross section of the break-out member.

18. Apparatus for removing break-out portions from a sheet of material, which comprises: a break-out surface having an aperture therein; a sheet of material containing a break-out portion, said sheet resting on the break-out surface so that the break-out portion extends over said aperture; a break-out member operative to press downwardly through said aperture and press said break-out portion downwardly through said aperture; a support surface associated with said break-out member to support said break-out portion, said support surface being guided in the direction of movement of the break-out member, wherein said support surface is movable within the aperture at least partially into a position at a spacing relative to the break-out surface and which in its rest position is located substantially parallel to and beneath the break-out portion in the sheet of material and which is adapted to be transferred into an inclined position relative to the sheet of material upon movement of the break-out portion by said break-out member upon downward movement of the break-out portion, and wherein the support surface is formed by portions of at least one roller body which is rotatable about an axis beside the path of movement of the break-out member, and wherein said roller body comprises two disk elements at a spacing relative to each other, said elements having peripheral contours thereof in mutual alignment and being on a spindle, wherein the path of movement of the break-out member extends between said disk elements.

* * * * *